US009300026B2

(12) United States Patent
Haunberger et al.

(10) Patent No.: US 9,300,026 B2
(45) Date of Patent: Mar. 29, 2016

(54) NONDIRECTIONAL RF POWER DIVIDER

(75) Inventors: Thomas Haunberger, Bad Reichenhall (DE); Manfred Stolle, Bad Aibling (DE); Claudia Daurer, Prutting (DE)

(73) Assignee: KATHREIN-WERKE KG, Rosenheim (DE)

( * ) Notice: Subject to any disclaimer, the term of this patent is extended or adjusted under 35 U.S.C. 154(b) by 15 days.

(21) Appl. No.: 14/233,599

(22) PCT Filed: Jun. 21, 2012

(86) PCT No.: PCT/EP2012/002630
§ 371 (c)(1),
(2), (4) Date: Jan. 17, 2014

(87) PCT Pub. No.: WO2013/013745
PCT Pub. Date: Jan. 31, 2013

(65) Prior Publication Data

US 2014/0191821 A1 Jul. 10, 2014

(30) Foreign Application Priority Data

Jul. 22, 2011 (DE) ..... 10 2011 108 316

(51) Int. Cl.
*H01P 5/12* (2006.01)

(52) U.S. Cl.
CPC ..... *H01P 5/12* (2013.01)

(58) Field of Classification Search
CPC ..... H01P 5/12
USPC ..... 333/126–127, 132
See application file for complete search history.

(56) References Cited

U.S. PATENT DOCUMENTS 3,166,723 A * 1/1965 Bock et al. ..... 333/111
6,847,268 B2 1/2005 Haunberger et al.

(Continued)

FOREIGN PATENT DOCUMENTS

CN 201623252 U 11/2010
CN 201699112 U 1/2011

(Continued)

OTHER PUBLICATIONS

H. Meinke et al., "Taschenbuch der Hochfrequenztechnik", Springer-Verlag, 1968.

(Continued)

*Primary Examiner* — Benny Lee
*Assistant Examiner* — Albens Dieujuste
(74) *Attorney, Agent, or Firm* — Nixon & Vanderhye P.C.

(57) ABSTRACT

An improved nondirectional radiofrequency power divider is characterized by the following features: —having an outer conductor (1) and/or outer conductor housing (1'), with a first inner conductor (11), wherein the first inner conductor (11) runs in the outer conductor (1) or in the outer conductor housing (1'), —with a second inner conductor (13), wherein the second inner conductor (13) runs in the space (15) which is formed between the first inner conductor (11) and the outer conductor (1) or the outer conductor housing (1'), —the second inner conductor (13) is electrically connected to a branch line running away therefrom or is provided therewith, the second inner conductor (13) is relatively adjustable and/or positionable in terms of the distance of said second inner conductor from the first inner conductor (11) and/or in terms of the distance of said inner conductor from the outer conductor (1) or from the outer conductor housing (1') so as to effect a variable power distribution.

13 Claims, 5 Drawing Sheets

(56) References Cited

U.S. PATENT DOCUMENTS

| | | | |
|---|---|---|---|
| 7,026,888 | B2 | 4/2006 | Antkowiak |
| 8,120,444 | B2 | 2/2012 | Haunberger et al. |
| 2003/0003814 | A1 | 1/2003 | Haunberger et al. |
| 2004/0222867 | A1 | 11/2004 | Antkowiak |
| 2009/0045887 | A1 | 2/2009 | Tervo |

FOREIGN PATENT DOCUMENTS

| | | |
|---|---|---|
| DE | 11 92 714 | 8/1963 |
| DE | 200 16 787 U1 | 4/2001 |
| DE | 10 2006 056 618 | 8/2012 |
| GB | 607 200 | 8/1948 |
| WO | WO 01/54222 | 7/2001 |
| WO | WO2013/170922 | 11/2013 |

OTHER PUBLICATIONS

English translation of the International Preliminary Report on Patentability and Written Opinion of the International Searching Authority mailed Feb. 6, 2014, issued in corresponding International Application No. PCT/ EP2012/002630.

Office Action dated Jul. 22, 2015, issued in corresponding Chinese Application No. 201280035416.6.

Chinese Search Report dated Nov. 3, 2014, issued in corresponding Chinese Application No. 201280035416.6.

* cited by examiner

NONDIRECTIONAL RF POWER DIVIDER

This application is the U.S. national phase of International Application No. PCT/EP2012/002630 filed 21 Jun. 2012 which designated the U.S. and claims priority to DE 10 2011 108 316.6 filed 22 Jul. 2011, the entire contents of each of which are hereby incorporated by reference.

The invention relates to a non-directional RF power divider.

A power divider to split or combine radio frequency power (RF power) has become known, for example from DE 10 2006 056 618.

Such a known power divider comprises a coaxial conductor with an outer conductor and a transformation inner conductor extending inside it. A coaxial sum port is provided on the front end of the outer conductor. On the opposite end of the outer conductor a head piece with at least two and preferably three or four single ports is formed, which comprise outer conductor connections. In this case the single ports have an inner conductor running through them in an axial direction, which is connected to the transformation inner conductor at its upper end. The feature of this known RF power divider is that the head piece is constructed as one piece with the single port, avoiding a mechanical connection point and in this case consists of a forged part, casting or milled part.

A generic RF circuit to achieve non-directional power division is also to be taken as known for example from "Taschenbuch der Hochfrequenztechnik" [High Frequency Technology Manual], H. Meinke and F. W. Gundlach, Springer-Verlag, Berlin/Heidelberg/New York, 1968, pages 373 and 374. Here the non-directional power division is independent of the direction in which the wave spreads out in the main conductor.

A series branch is described therein which, in addition to an outer conductor and a coaxial inner conductor running inside it, comprises a third conductor provided between the existing conductors, and specifically as a tube concentrically surrounding the inner conductor. With such a construction, two loads can be connected, which act as two loads connected in series in relation to the approaching wave and are located in the division plane. The impedance of the undivided conductor is divided in this case into the corresponding impedance for the first and for the second load.

A corresponding implementation of this principle is to be taken as known from the generic U.S. Pat. No. 7,026,888 B2.

In the case of this non-directional RF power divider, a coupler is provided on each of the opposite end faces of a housing forming the outer conductor to connect a coaxial conductor, the housing forming the outer conductor being provided with a central drilled hole in which the first or primary inner conductor is provided in a coaxial arrangement running between the coaxial connections.

Furthermore, in the space between the inner or primary conductor and the outer conductor a tube surrounding the inner conductor is provided, which constitutes the second inner conductor. This second inner conductor is retained structurally relative to the first or primary inner conductor via dielectric discs.

From the second inner conductor constructed as a tube, a tap conductor running radially and perpendicularly then extends outwards through a drilled hole in the outer conductor housing where a third series coaxial coupler is provided to connect a coaxial branch conductor.

A pre-set RF power division is hereby likewise achieved.

In contrast to the present generic prior art in the form of a non-directional power divider with a three-port circuit, directional couplers that are four-port circuits are also known in principle, which are therefore a different operating principle in which the fourth port is also terminated, for example, via a terminating resistor.

Reference is made to U.S. Pat. No. 3,166,723 A as being representative of such four-port directional couplers, which comprise a standard inner conductor between a first and a second port in an outer conductor housing, a conductor connection then being located in the same outer conductor housing between the third and fourth ports, specifically with a U-shaped coupling element. This U-shaped coupling element can be moved transverse to the inner conductor running between the first and second ports via an adjustment mechanism, i.e. brought closer to the inner conductor or moved further away from it. This microwave directional coupler known from U.S. Pat. No. 3,166,723 A can be operated bi-directionally, the decoupled signals occurring at different ports.

A directional coupler using the corresponding four-port technology has become known, for example, from US 2009/0045887 A1. This directional coupler comprises two key or coupler conductors, between which the inner conductor running from the first to the second port is arranged all the way through. Both the key or coupler conductors are shorter than a quarter wavelength relative to the operating frequency. This wavelength should preferably be in the region of 1/12 of the operating wavelength, for example. Due to the interconnection a high level of directionality should be achieved with short conductors.

Finally, a coupler device for use in radio frequency voltage sources connected in accordance with the feed-through procedure is also taken as known from DE 1 192 714 A. In this case, the coupler device has an output circuit with an inner and an outer conductor. Furthermore, a coupler device is provided with a coupler conductor, which starting from a central position is arranged so it is movable towards both the inner and the outer conductor of the conductor circuit. According to column 3, lines 13 to 20 of the aforementioned publication, a coupler conductor portion is to be connected to two through conductors via spring clips matching the wave impedance if possible.

In contrast, the object of the present invention is to create an improved non-directional radio frequency power divider starting from the generic prior art with which a variably adjustable division of power can be effected in a simple manner without repercussions for the adjustment of the main conductor.

The solution according to the invention is characterised in that the second inner conductor, which is arranged between the primary or main inner conductor and the outer conductor, is constructed such that the distance between the second inner conductor and the first inner conductor and/or the outer conductor can be changed, i.e. is variably adjustable. This is because, depending on the variable distance, there emerges a variable radio frequency power distribution between the first and second inner conductors according to the series branch principle (see "Taschenbuch der Hochfrequenztechnik", H. Meinke and F. W. Gundlach, Springer Verlag, Berlin/Heidelberg/New York, 1968, pages 373 and 374). A non-directional RF power divider is thus created, which facilitates variable power distribution using simple means.

In this case the adjustment mechanism can be achieved through appropriate technical measures, for example using a radial guiding device, which comprises, for example, two non-conductive pins or projecting devices, which penetrate the outer conductor and thus make it possible for the relative position of the second inner conductor relative to the first inner conductor and/or the outer conductor to be adjusted from outside.

The second inner conductor can be formed variably in large regions.

In a preferred embodiment it has a half-pipe shaped form. This facilitates any required relative adjustment in a radial direction, i.e. transverse to the inner and/or outer conductor arrangement, in the space between the inner conductor and the outer conductor within a wide range.

In a cross-sectional view, however, this second inner conductor does not have to have a half-pipe shaped form. It can be different to a circular shape in construction. Preferably, however, it has a semi-circular shape in cross section with an inclined surface that is concave towards the inner conductor and convex towards the outer conductor.

In cross section, however, the second inner conductor can also be plate-shaped or designed such that it is U- or V-shaped in cross section and specifically such that the inner conductor can dip into the space between the U- or V-shaped design of the second inner conductor.

Apart from this, both the inner conductor but also the outer conductor housing can have any required cross-sectional form. The inner conductor does not absolutely have to be cylindrical or tubular, i.e. with a circular cross section, either but can, for example, be constructed with a rectangular or square cross section, generally an n-polygonal cross section. This also applies accordingly to the second inner conductor, the inner surface contour of the outer connector or the outer connector housing, etc.

Therefore a very wide bandwidth and above all infinitely adjustable power distribution is facilitated through the present invention according to the series branch principle, for example in a range of 380 MHz-2700 MHz. In this case the power distribution can, for example, be between 6 and 20 dB.

This is preferably achieved as mentioned by a nested inner conductor system, the second inner conductor being transversely (i.e. preferably radially) movable relative to the first inner conductor or vice versa.

The sums of the two series impedances (roughly) give the bandwidth of the system wave impedance, this being despite the variable power distribution.

In this case, the length of the coupler zone can be bigger than $\lambda/10$, relative to the lower frequency limit of the RF frequency to be transferred.

The invention is described hereinafter with reference to drawings, in which in detail FIG. 1 shows an exploded view of the first embodiment according to the invention;

Figure 1:
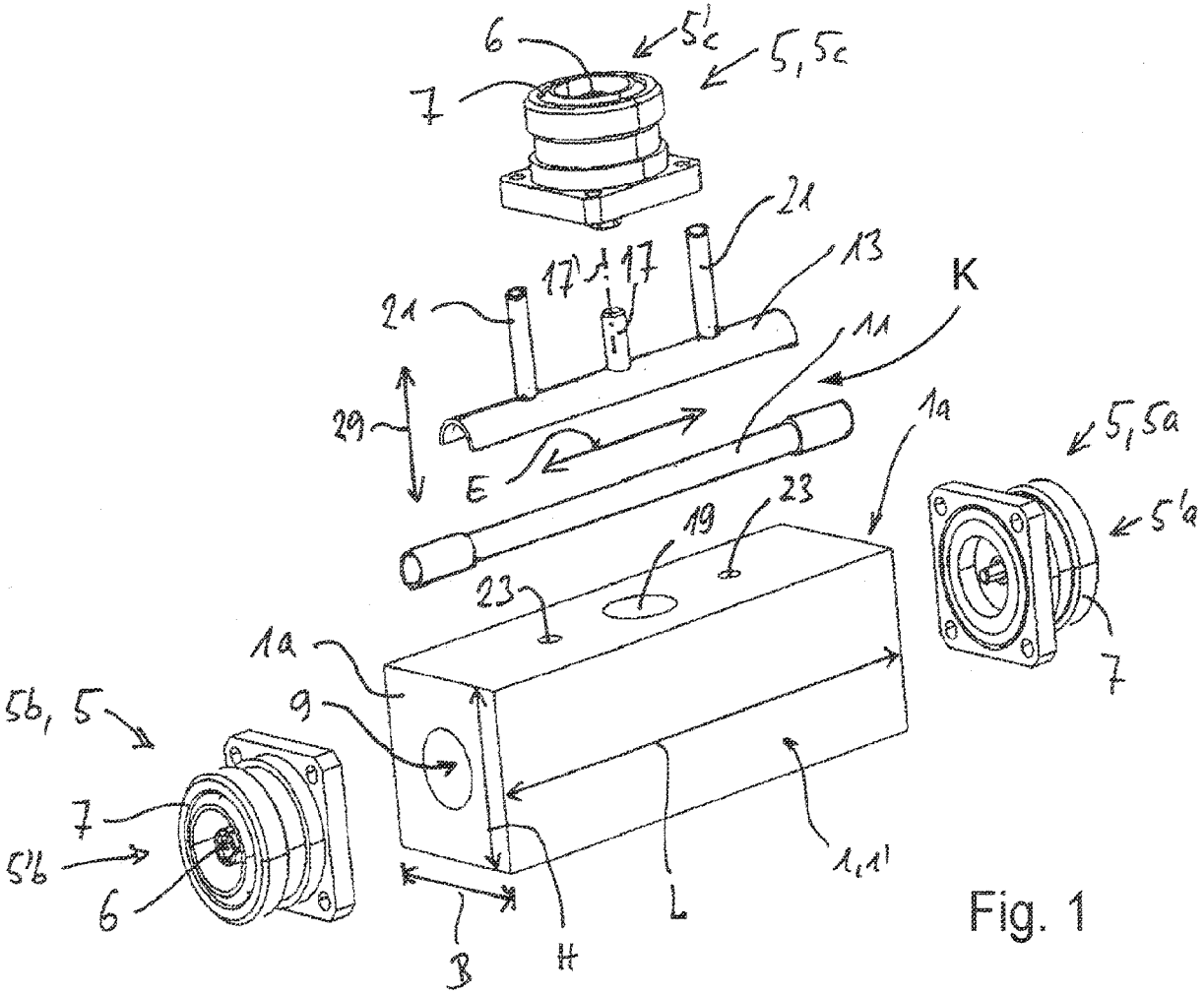
Figure 2:
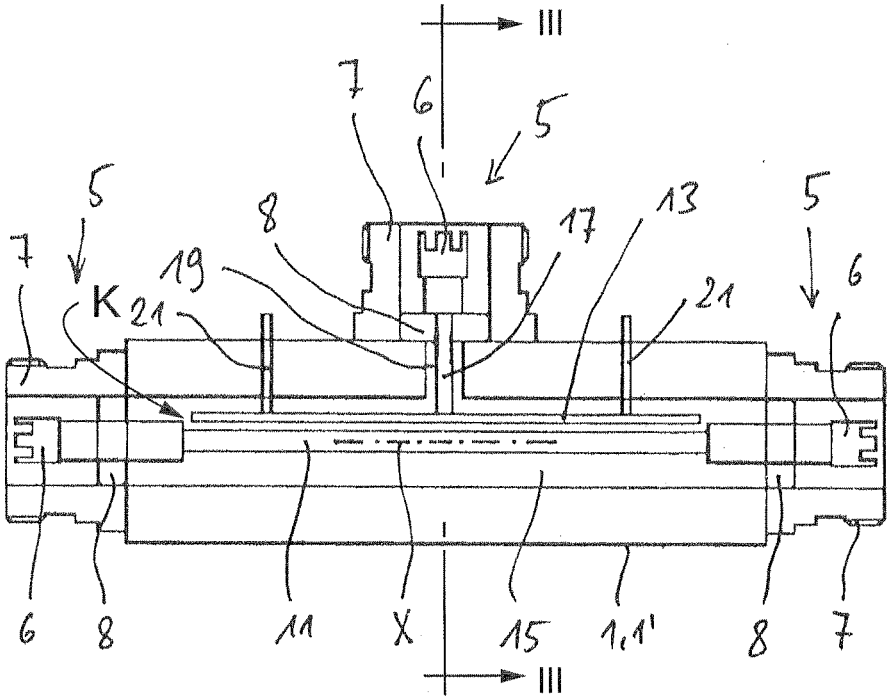
FIG. 2 shows an axial longitudinal section through the embodiment according to FIG. 1 in its assembled state.
Figure 3:
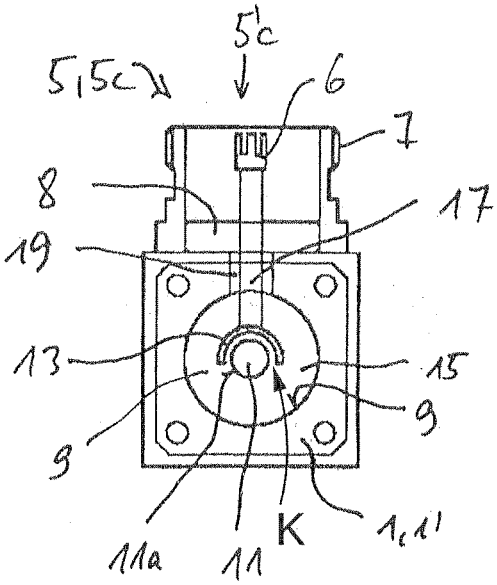
FIG. 3 shows a cross sectional view along the line III-III in FIG. 2.
Figure 4A:
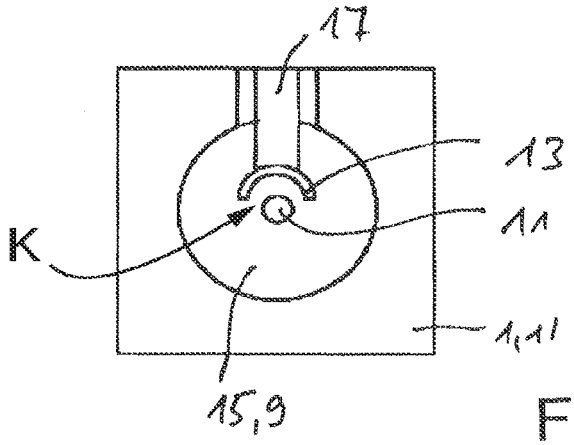

FIG. 4*a* shows an example schematic cross sectional view of the second inner conductor of FIGS. 1-3.

Figure 4B:
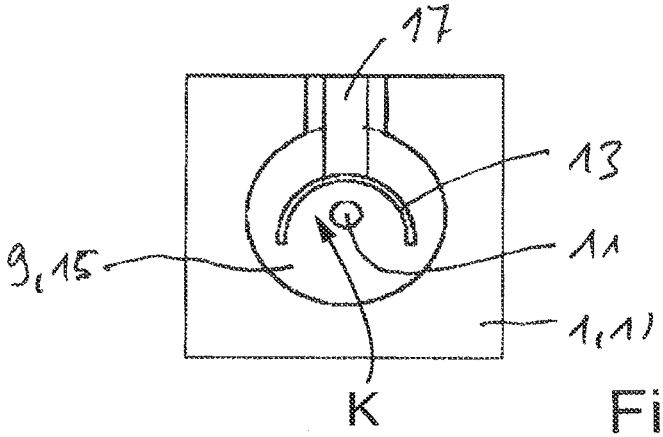

FIG. 4*b* shows a further embodiment where the second inner conductor has a larger curvature in cross-section.

Figure 4C:
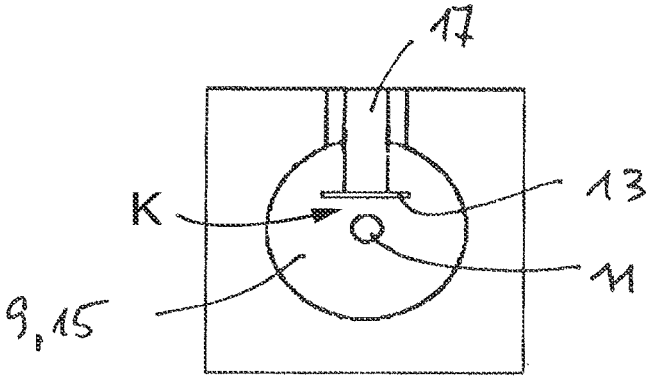

FIG. 4*c* shows a further embodiment where the second inner conductor is plate-shaped in cross section.

Figure 4D:
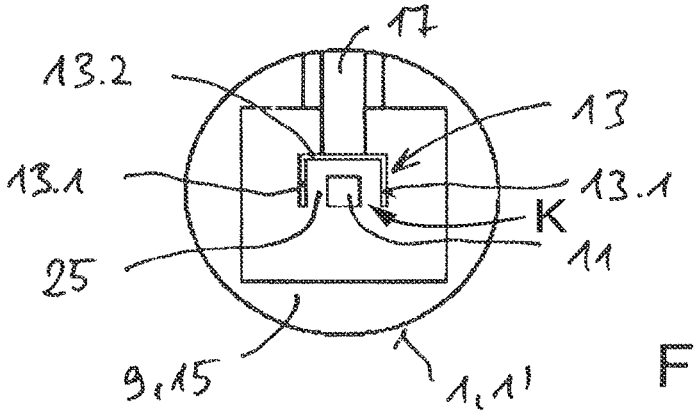

FIG. 4*d* shows a further embodiment where the second inner conductor is U-shaped in cross-section.

Figure 4E:
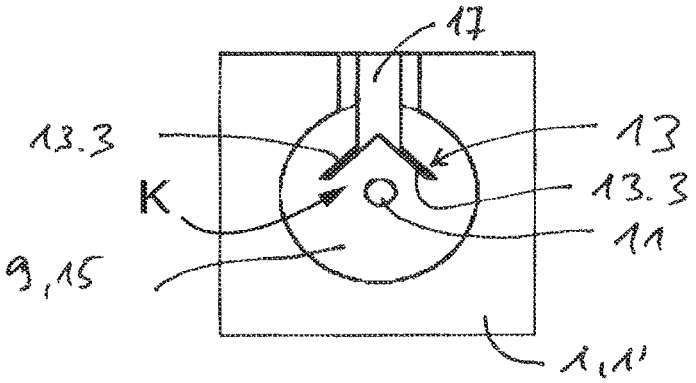

FIG. 4*e* shows a further embodiment where the second inner conductor is V-shaped in cross section with two diverging web sections.

Figure 5A:
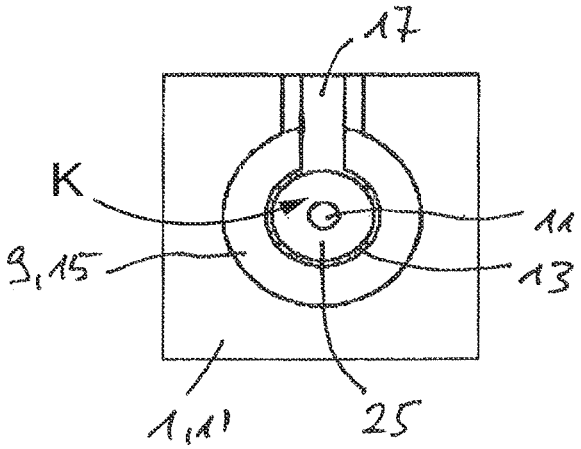

FIG. 5*a* shows a further embodiment where the second outer conductor consists of a tube.

Figure 5B:
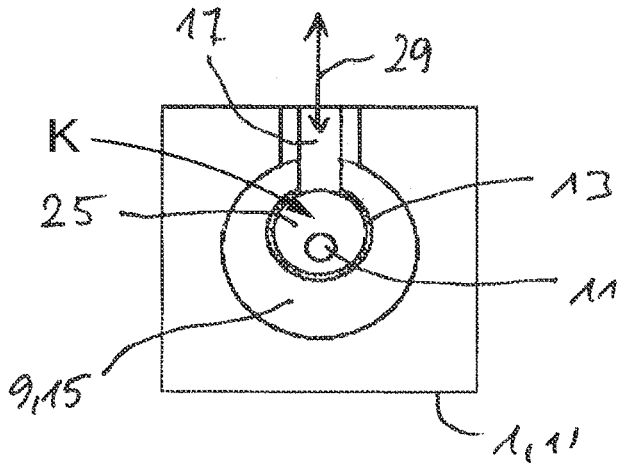

FIG. 5*b* shows the FIG. 5*a* embodiment wherein an adjusted position of the second outer conductor relative to FIG. 5*a* is shown by means of which the minimal distance to the first inner conductor and also to the outer conductor is reduced and thus a variable power distribution or power summation is effected.

Figure 6A:
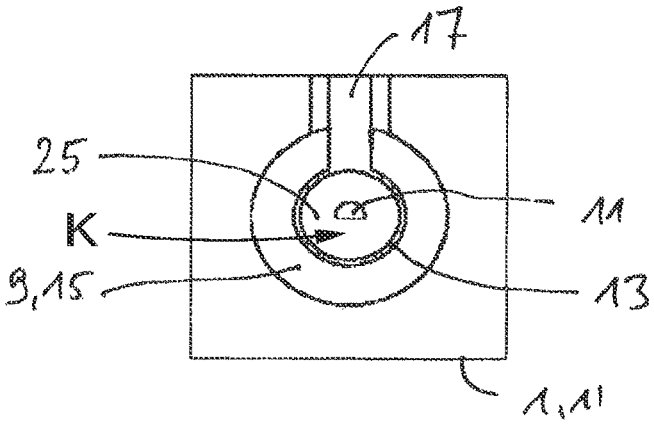

FIG. 6*a* shows a further embodiment where the second inner conductor is tubular and the cross section of the first inner conductor is semi-cylindrical.

Figure 6B:
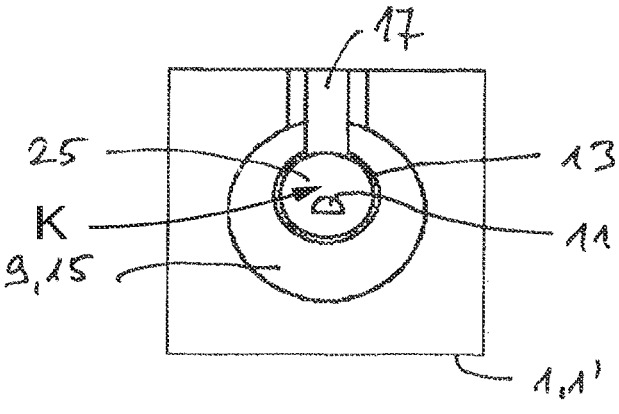

FIG. 6*b* shows the FIG. 6*a* embodiment where adjustment of the second inner conductor from the position shown in FIG. 6*a* to the position reproduced in FIG. 6*b* provides a larger adjustment space.

In FIG. 1*a* first embodiment according to the invention of a non-directional RF power divider is shown.

In this case the RF power divider comprises an outer conductor 1 with an outer conductor housing 1' made from electrically conductive material, which can have any cross sectional form required. In the embodiment shown, the outer conductor is rod-shaped with a square cross section transverse to its longitudinal extension L. In other words, the outer conductor 1 has a longitudinal extension L, a height H and a width B, the height and width being equal in the embodiment shown.

On each of the opposite end walls 1*a* of the housing-shaped outer conductor 1, a coaxial coupler 5 is then provided, which is screw-mountable, for example, and which comprises in the known manner an inner conductor connector 6, an outer conductor socket 7 and normally a dielectric retaining device 8, by means of which the electrically conductive coaxial inner conductor or the inner conductor terminal 5*a* is retained relative to the cylindrical outer conductor socket 5*b*.

In the embodiment shown, the illustrated coaxial coupler 5 is screw-mountable to each of the two opposite ends 1*a* using screws. The configuration and fixing of the mentioned coaxial coupler 5 and outer conductor 1 can, however, be achieved differently, for example such that the outer conductor sockets 7 are an integral component of the outer conductor 1, for example firmly bonded with the outer conductor 1. In this case only the inner conductor connectors 6 are then inserted into these outer conductor sockets 7 and in this case retained by dielectric retention devices 8 (for example, disc-shaped dielectric (insulating) retention devices 8) (FIG. 2).

It can also be seen from the exploded view according to FIG. 1 that the outer conductor 1 is penetrated centrally in its longitudinal direction L by a drilled locating hole 9, which is cylindrical in the embodiment shown.

In a coaxial arrangement, an inner conductor 11 is arranged in the drilled locating hole 9, in the embodiment shown the so-called first primary or main inner conductor 11, which extends through the outer conductor 1 between the inner conductor connectors 6. The inner conductor can be retained in the coaxial couplers 5 via separate dielectric retaining elements relative to the outer conductor 1 or via the inner conductor connectors 6. In this case the retaining device, which is constructed as insulators, is preferably arranged adjacent to the front ends 1*a* in the outer conductor housing 1' so that it does not collide with the second inner conductor, which is described hereinafter.

Finally, a second or secondary inner conductor 13 is also provided, which is of semi-cylindrical construction in the embodiment shown. As can be seen in particular from the sectional view according to FIGS. 2 and 3, this second inner conductor 13 is arranged in the space 15 between the first inner conductor 11 and the outer conductor 1, i.e. in the space in the outer conductor housing 1', which is formed between the surface 11*a* of the inner conductor 11 and the inner wall surface 9*a* of the drilled locating hole 9 in the outer conductor 1.

As emerges from the drawings, the second inner conductor 13 is provided with or connected to a branch conductor 17, which extends preferably radially, meaning preferably perpendicular to the direction E that the inner and/or outer conductor runs in, perpendicular to it in the embodiment shown.

The longitudinal direction E that the first inner conductor 11 runs in preferably concurs with the axial longitudinal axis L of the outer conductor 1 and the outer conductor 1'. This means the central axis X, shown by a dashed and dotted line in FIG. 2, which runs through the whole of the RF power divider, simultaneously constitutes the central longitudinal axis E that the first inner conductor 11 runs along. It is simultaneously the concentric central axis for the drilled locating hole 9 in the outer conductor 1, the hole being cylindrical in the embodiment shown. In this case, the inner conductor 13 referred to normally runs parallel to this central axis X, and therefore parallel to the inner conductor 11.

This branch conductor 17 runs through a drilled outlet hole 19 in the outer conductor housing 1' so that an additional coaxial coupler 5 can be mechanically and electrically connected in this place, and specifically likewise with an inner conductor connector 6, an outer conductor socket 7 and a dielectric retention device 8, by means of which the inner conductor 6 is retained and guided with a gap between and avoiding galvanic contact with the outer conductor 1.

Finally, it can also be seen from the sectional views that in the embodiment shown the second inner conductor 13 is provided with two bolt-shaped or bolt-like adjustment devices 21, which preferably extend radially or perpendicular to the direction E that it extends in and in the embodiment shown preferably consist of an electrically non-conductive and/or dielectric material and in this case penetrate corresponding adjustment and/or retention holes 23 in the outer conductor housing 1', meaning at least extend into them here and preferably extend to the outside of the outer conductor housing in order to be able to perform a radial adjustment of the second inner conductor 13 by these means, which will be described more detail below.

An RF power divider (or summing unit) is therefore formed by such an arrangement, which in the embodiment shown comprises three coaxial couplers 5, namely 5*a*, 5*b* and 5*c*, namely with a coaxial coupler 5*a*, which forms the input port 5'*a*, another coaxial coupler 5*b* provided on the opposite end of the outer conductor 1, which for example constitutes the first output port 5'*b* for the first load and with a third coaxial coupler 5*c*, which forms the connector 5'*c* or the output for the second inner conductor 13.

Using such an arrangement an RF power divider can therefore be achieved in principle if, for example, RF power is fed into the first connector or input port 5'*a*, this RF power then being distributed across the first and second inner conductors 11, 13 and fed to the second and third connector ports 5*b* and 5*c*, specifically according to the series branch principle.

In this case, the wave impedance Z present at the input is broken down into wave impedance Z1 at the second connector port 5*b* and wave impedance Z3 at the third connector port, the sum of the divided wave impedances remaining constant. In other words, the sum of the two series impedances is (roughly) the system wave impedance in bandwidth despite the variable power distribution. In this case the length of the coupler zone K (and thus the length of the second inner conductor 13) is preferably larger than $\lambda/10$ relative to the lower frequency limit of the frequency band to be transferred or frequency to be transferred.

Likewise, a summation of the power can be performed using the RF power divider described if namely corresponding RF power is fed in at the second and third connector ports 5*b* and 5*c*, which can then be tapped at the first connector port 5*a*.

In order to now facilitate a variable power distribution or summation the relative position of the second inner conductor 13 relative to the first inner conductor and/or the outer conductor 1 can be altered.

To this end, the second inner conductor is adjusted according to the illustrated double-headed arrow 29 towards the first inner conductor 11 or, for example, away from it in a radial direction, whereby the distances and therefore the wave impedances assigned to the first and the second inner conductors alter accordingly, but the sum remains constant. The radio frequency power distribution between the second and third connector ports changes accordingly.

In other words therefore in order to change the power distribution between a first and second load, the first and/or the second inner conductor 11 and 13 respectively are moved relative to each other (in the embodiment shown the second inner conductor 13 is moved in relation to the first inner conductor 11) with at least one radial component in order to change the distance between the two.

Thus a distribution of power that can be freely selected within wide limits and above all is variable (for example in a range of 380 MHz-2700 MHz in the form of power division of 6 dB-20 dB) can be set, and this can be done with the simplest of means.

In the embodiment shown, the second coaxial conductor is constructed such that it is semi-cylindrical in cross section transverse to its longitudinal direction L or that in which it extends E so that in a central or intermediate position it forms a precise coaxial position to the inner and/or outer conductors, meaning to the cylindrical inner surface 9*a* of the drilled location hole 9 of the outer conductor 1.

In this case in the embodiment shown the branch or connection conductor 17, which is electrically connected to the second inner conductor 13, normally galvanically connected, is designed such that it aligns with the associated inner conductor connector 6 of the third coaxial coupler 5, 5*c*, i.e. is relatively movable in its axial direction, i.e. effectively forms a telescopic connection. This is because the relative change in distance in the radial direction of the second inner conductor relative to the first inner conductor 11 and thus also relative to the outer conductor 1 occurs in a direction equivalent to the double-headed arrow 29, which extends parallel to the longitudinal extension 17', i.e. the central axis 17' of the branch or junction 17. In a corresponding alignment, the inner conductor connector or the inner conductor connection 6 of the third coaxial coupler 5*c* connects to it partially in an overlapping arrangement. Thus a galvanic tapping of the RF signal to this coaxial coupler 5 is always secured.

Likewise, as a result of the drilled holes 23 in the outer conductor housing 1' and the adjustment means 21, which are engaged in them and are movable in an axial direction and which are rod or bolt-shaped in the embodiment shown, the axial extensions are also arranged parallel to the adjustment direction 29 and therefore parallel to the axial extension direction 17' of the connecting or branch conductor 17, so that the second inner conductor 13 is accordingly movable and therefore adjustable in the adjustment direction 29.

As a result, when a radial adjustment is made, the semi-cylindrical cross sectional form of the second inner conductor 13 does not necessarily have to remain concentric to the inner and/or outer conductors, which is, however, of no significance in principle.

With reference to the following schematic cross sectional views it is only intended to show that the second outer conductor can also have many different forms and constructions in relation to the inner or outer conductor.

With reference to FIG. 4*a*, the embodiment according to FIGS. 1 to 4 is reproduced in schematic repetition.

With reference to FIG. 4*b*, it is shown that the second outer conductor can have a very much larger curvature in cross section, i.e. have a form where the whole sectional form can never be concentric to the inner and/or outer conductor, meaning the surface 9*a* of the drilled locating hole in the outer conductor 1.

In the schematic cross sectional view according to FIG. 4*c* a variant is shown in which the second inner conductor is plate-shaped in cross section.

In the case of the variant according to FIG. 4*d*, the inner conductor is U-shaped in cross section so that as a result a cavity 25 is formed between the two lateral webs 13.1 and the connecting web 13.2 where the first inner conductor 11 can dip more or less further into this cavity 25 at least in some relative adjustment positions of the second inner conductor 13 relative to the first inner conductor 11. With reference to FIG. 4*d*, it is likewise only schematically shown that the first inner conductor 11 can also have various cross-sectional forms and does not necessarily have to be cylindrical in cross section, but can for example have a polygonal cross section, in particular a square cross section. Moreover, the outer conductor 1 and the outer conductor housing 1' are tubular.

With reference to FIG. 4*e*, it is shown for example that the second inner conductor 13 is V-shaped in cross section with two diverging web sections 13.3.

With reference to the embodiments so far only the second inner conductor is movable relative to the first inner conductor and/or relative to the outer conductor.

However, arrangements are also feasible in principle where, for example, the second inner conductor is not adjustable in relation to the outer conductor, only the first inner conductor being arranged so that it is radially adjustable relative to the outer conductor and/or to the second inner conductor and retained. This could, for example, be achieved in that the coaxial couplers 5*a*, 5*b* located opposite each other on the outer conductor housing 1' are adjustable together in their relative position to the outer conductor in a radial direction so that the first inner conductor 11, which is retained and guided in between them, is likewise relatively adjustable in the direction of the double-headed arrow 29, i.e. towards the second inner conductor or away from it. In this case the distance between the first inner conductor 11 and the inner surface 9*a* of the drilled location hole 9, i.e. the distance to the outer conductor 1, likewise changes.

Finally, variable power distribution can also be effected if, for example, an arrangement of the second inner conductor is achieved according to the embodiment according to FIGS. 5*a* and 5*b*. The embodiment is shown in a schematic cross-sectional view transverse to the longitudinal extension L of the RF power divider. In this variant, the first inner conductor 11 is preferably not adjustable relative to the outer conductor 1 in its radial position, although it could also be arranged so as to be adjustable.

In this embodiment, the second outer conductor 13 consists of a tube, preferably with a hollow cylindrical form, this second outer conductor 13 having a diameter size with a cavity 25 that is large enough in relation to the outer diameter of the first inner conductor and small enough in relation to the inner diameter of the outer conductor 1 that the tubular second inner conductor 13 thus formed is adjustable according to the illustrated double-headed arrow 29 relative to the first inner conductor 11 and to the outer conductor 1, and that no galvanic contact is effected between the second inner conductor 13 and the first inner conductor 11 on the one hand and between the second inner conductor 13 and the outer conductor 1 on the other.

With reference to the cross-sectional view according to FIG. 5*b*, an adjusted position of the second outer conductor 13 relative to FIG. 5*a* is shown by means of which the minimal distance to the first inner conductor 11 and also to the outer conductor 1 is reduced and thus a variable power distribution or power summation is effected.

With reference to FIGS. 6*a* and 6*b*, two different adjustment variants of the second conductor 13 in a relative position to the first conductor 11 and/or to the inner wall surface 9*a* of the drilled locating hole 9 in the outer conductor 1 are shown. Here, the cross section of the first inner conductor 11 is, for example, semi-cylindrical therefore having a flat portion on the side on which the distance between the second and the first inner conductors 13, 11 reduces during the adjustment of the second inner conductor 13 from the position shown in FIG. 6*a* to the positions reproduced in FIG. 6*b* in order to therefore provide a larger adjustment space 25.

This also shows that the cross-sectional form of the first inner conductor 11 can also be constructed differently in large regions.

Finally, it should be mentioned that the cross-sectional form of the second inner conductor 13 does not have to be a hollow cylinder either, even if it is formed as a hollow conductor tube, but can, for example, have an n-polygonal cross section or an oval cross section, etc., as a result of which there is a larger adjustment region of the second inner conductor 13 relative to the first inner conductor 11.

In the cases where the second inner conductor 13 is formed as a tubular inner conductor, the internal first inner conductor 11 is normally retained by the dielectric retention elements, which are positioned adjacent to the beginning and end of the second inner conductor 13, which has a shorter length than the first inner conductor 11, in the drilled locating hole 9 in the outer conductor housing 1'. It would also be possible for the first inner conductor 11 to be retained solely by the inner conductor connectors or the inner conductor connection 6 of the coaxial couplers 5*a* and 5*b* respectively.

In all of these described cases, the adjustment of the second inner conductor has been effected via the adjustment and retention means 21. In this case corresponding mechanically appropriate adjustment means can be inserted and used, which are of no significance to the realisation of the invention. Preferably such adjustment means should be used where the relative position of the second inner conductor in relation to the first inner conductor and/or the outer conductor can be adjusted as finely as possible since only minimal radial changes in position can lead to a noticeably different power distribution.

In order to prevent galvanic contact between the first and second inner conductors 11, 13 and between the second inner conductor 13 and the outer conductor 1 and the outer conductor housing 1' in any case in the different adjustment options, either the corresponding maximum relative adjustment movement of the inner conductors in relation to each other and/or to the limiting wall of the outer conductor 1 can be limited by mechanical borders or stops or alternatively or in addition, the corresponding parts can be coated in an insulating or dielectric layer in order to securely prevent corresponding galvanic contact between the elements referred to.

As has already been dealt with, the length of the coupling zone K is preferably approximately $\lambda/10$, $\lambda$ representing the frequency limit. The coupling zone can, however, also be larger than λ/11 or for example λ/12, etc.

The preferred values for the length of the coupling zone K are such that the coupling zone is preferably larger than $$\lambda/10-40\%<K<\lambda/10+40\%.$$

In this case the preferred values can, however, satisfy the following inequations with regard to the length of the coupling zone K, namely:

$$\lambda 10-30\%<K<\lambda/10+30\%.$$

or $$\lambda 10-20\%<K<\lambda/10+20\%$$

or $$\lambda 10-10\%<K<\lambda/10+10\%.$$

In other words, the length of the coupling zone K preferably has the following values:

$$0.6\cdot\lambda/10<K<1.4\cdot\lambda/10$$

or $$0.7\cdot\lambda/10<K<1.3\cdot\lambda/10$$

or $$0.8\cdot\lambda/10<K<1.2\cdot\lambda/10$$

or $$0.9\cdot\lambda/10<K<1.1\cdot\lambda/10$$

or $$K>\lambda/10 \text{ or } \lambda/11.$$

The invention claimed is:

1. Non-directional radio frequency power divider comprising:

an outer conductor and/or outer conductor housing, a first inner conductor, the first inner conductor extends inside the outer conductor or in the outer conductor housing, a second inner conductor, the second inner conductor extends inside the space, which is formed between the first inner conductor and the outer conductor or the outer conductor housing, the second inner conductor is electrically connected to or provided with a branch conductor extending away from the second inner conductor, the branch conductor is positioned in the center between two ends of the second inner conductor, the second inner conductor is relatively adjustable and/or positionable in terms of a first distance from the first inner conductor and/or in terms of a second distance from the outer conductor or outer conductor housing so as to effect a variable power distribution;

wherein the cross section of the second inner conductor is U- or V-shaped or plate-shaped.

2. Non-directional radio frequency power divider comprising:

an outer conductor and/or outer conductor housing, a first inner conductor, the first inner conductor extends inside the outer conductor or in the outer conductor housing, a second inner conductor, the second inner conductor extends inside the space, which is formed between the first inner conductor and the outer conductor or the outer conductor housing, the second inner conductor is electrically connected to or provided with a branch conductor extending away from the second inner conductor, the branch conductor is positioned in the center between two ends of the second inner conductor, the second inner conductor is relatively adjustable and/or positionable in terms of a first distance from the first inner conductor and/or in terms of a second distance from the outer conductor or outer conductor housing so as to effect a variable power distribution; and wherein the first and/or second inner conductors have lengths and define a coupling zone (K) therebetween, and the length of the coupling zone (K) between the first and second inner conductors is larger than 0.6λ/10 and/or smaller than 1.4λ/10, λ representing the lower frequency limit.

3. RF power divider according to claim 2, wherein the length of the first and/or second inner conductors and therefore the length of the coupling zone (K) between the first and second inner conductors is larger than 0.7λ/10 and smaller than 1.3λ/10.

4. RF power divider according to claim 2, wherein the length of the first and/or second inner conductors and therefore the length of the coupling zone (K) between the first and second inner conductors is larger than λ/10 or larger than λ/11, with reference to the lower frequency limit.

5. RF power divider according to claim 2, wherein the outer conductor or the outer conductor housing comprises two opposite connecting ports that are offset in relation to each other to each of which a coaxial conductor is or can be connected and that between these connecting ports a third connecting port is arranged, by means of which another coaxial conductor is or can be connected, the third connecting port comprising an inner conductor connection, which is electrically connected to the second inner conductor.

6. RF power divider according to claim 2, wherein the first inner conductor is arranged concentrically relative to the outer conductor and a drilled locating hole in the outer conductor or in the outer conductor housing and that the second inner conductor is adjustable and positionable in relation to the drilled locating hole in a radial direction or with a radial component.

7. RF power divider according to claim 2, wherein the outer conductor or the outer conductor housing has a drilled output hole, which is penetrated in a galvanically contact-free manner by the branch conductor, which is connected to the second inner conductor or part of the second inner conductor.

8. RF power divider according to claim 7, wherein the branch conductor is bolt-shaped and firmly connected or firmly bonded to the second inner conductor.

9. Non-directional radio frequency power divider comprising:

an outer conductor and/or outer conductor housing, a first inner conductor, the first inner conductor extends inside the outer conductor or in the outer conductor housing, a second inner conductor, the second inner conductor extends inside the space, which is formed between the first inner conductor and the outer conductor or the outer conductor housing, the second inner conductor is electrically connected to or provided with a branch conductor extending away from the second inner conductor, the branch conductor is positioned in the center between two ends of the second inner conductor, the second inner conductor is relatively adjustable and/or positionable in terms of a first distance from the first inner conductor and/or in terms of a second distance from the outer conductor or outer conductor housing so as to effect a variable power distribution;

wherein the branch conductor is constructed such that the branch conductor is at least one of axially or telescopically movable to an inner conductor connection of a third coaxial coupler.

10. Non-directional radio frequency power divider comprising:

an outer conductor and/or outer conductor housing, a first inner conductor, the first inner conductor extends inside the outer conductor or in the outer conductor housing, a second inner conductor, the second inner conductor extends inside the space, which is formed between the first inner conductor and the outer conductor or the outer conductor housing, the second inner conductor is electrically connected to or provided with a branch conductor extending away from the second inner conductor, the branch conductor is positioned in the center between two ends of the second inner conductor, the second inner conductor is relatively adjustable and/or positionable in terms of a first distance from the first inner conductor and/or in terms of a second distance from the outer conductor or outer conductor housing so as to effect a variable power distribution;

wherein at least one adjustment or retention device is provided, of an electrically non-conductive or dielectric material, which penetrates the outer conductor or the outer conductor housing in a corresponding drilled output hole, whereby the position of the second inner conductor is variably adjustable relative to the first inner conductor or the outer conductor or the inner surface of the drilled locating hole in the outer conductor housing.

11. RF power divider according to claim 2, Non-directional radio frequency power divider comprising:

an outer conductor and/or outer conductor housing, a first inner conductor, the first inner conductor extends inside the outer conductor or in the outer conductor housing, a second inner conductor, the second inner conductor extends inside the space, which is formed between the first inner conductor and the outer conductor or the outer conductor housing, the second inner conductor is electrically connected to or provided with a branch conductor extending away from the second inner conductor, the branch conductor is positioned in the center between two ends of the second inner conductor, the second inner conductor is relatively adjustable and/or positionable in terms of a first distance from the first inner conductor and/or in terms of a second distance from the outer conductor or outer conductor housing so as to effect a variable power distribution;

wherein the second inner conductor has a semi-cylindrical cross sectional form transverse to at least one of a longitudinal direction (L) of the second inner conductor and a direction in which the second inner conductor extends and is arranged such that a concave portion of the second inner conductor faces the first inner conductor and a convex portion of the second inner conductor faces the inner wall surface of the outer conductor.

12. Non-directional radio frequency power divider comprising:

an outer conductor and/or outer conductor housing, a first inner conductor, the first inner conductor extends inside the outer conductor or in the outer conductor housing, a second inner conductor, the second inner conductor extends inside the space, which is formed between the first inner conductor and the outer conductor or the outer conductor housing, the second inner conductor is electrically connected to or provided with a branch conductor extending away from the second inner conductor, the branch conductor is positioned in the center between two ends of the second inner conductor, the second inner conductor is relatively adjustable and/or positionable in terms of a first distance from the first inner conductor and/or in terms of a second distance from the outer conductor or outer conductor housing so as to effect a variable power distribution;

wherein the second inner conductor is tubular and runs parallel to the first inner conductor and is relatively adjustable transverse or radially to the said first inner conductor, the first inner conductor extending inside the second inner conductor.

13. RF power divider according to claim 12, wherein the first inner conductor is retained by retaining elements, which are insulating and/or consist of a dielectric material, relative to the outer conductor or the outer conductor housing and specifically adjacent to the end of the second inner conductor and/or that the first inner conductor is retained by dielectric retaining elements, which fix the inner conductor connection in place.

* * * * *